US005542368A

United States Patent [19]

Yoshioka

[11] Patent Number: 5,542,368

[45] Date of Patent: Aug. 6, 1996

[54] LIGHTWEIGHT ANCHOR WITH TAIL FIN

[76] Inventor: Kenji Yoshioka, 122-4. Higashibun, Tsunomine-cho, Anan-shi Tokushima, Japan

[21] Appl. No.: 283,355

[22] Filed: Aug. 1, 1994

[51] Int. Cl.[6] ..... B63B 21/32

[52] U.S. Cl. ..... 114/301; 114/294

[58] Field of Search ..... 114/301, 294, 114/297, 299, 303; D12/215

[56] References Cited

U.S. PATENT DOCUMENTS 4,523,539 6/1985 Granger ..... 114/299

5,188,055 2/1993 Kershner ..... 114/299

*Primary Examiner*—Edwin L. Swinehart

[57] ABSTRACT

A lightweight anchor, with its upward-bent tail fin, big-notched fluke and a shank of steel bar bent into a U shape, together with its entire shape, has a great hold of the bottom. The anchor when stuck in a bottom obstacle can be recovered from the bottom simply by moving the ship of its user to the opposite position of its mooring and giving a tug or two to its anchor rope. Because it is simply structured and easy of fabrication with immovable fluke, tail fin and shank, it reduces the cost of fabrication and enhances safety of handling. It avoids most of the demerits of conventional lightweight anchors by its simple structure and its peculiar shape, but its position-correcting mechanism is most remarkable.

4 Claims, 3 Drawing Sheets

LIGHTWEIGHT ANCHOR WITH TAIL FIN

BACKGROUND OF THE INVENTION

The present invention relates to lightweight anchor. Various types of anchors have been devised, each having its good points and its bad ones:

One known type of anchor, when stuck between rocks or in an obstacle such as a crack or a cleft of seabed, has relied on some force excerted by its user on board a ship in recovering the anchor from the bottom. However, this type of anchor has been either a too complicated one with too many moving parts to be readily manipulated by its user, or a too costly one, or both. By 'some force' is meant either one of these:

1. The gravity of a heavy metal weight (often with a guide attachment to it) which slides down along the rope and hits the stuck anchor at its small protuberance mechanically triggering its release from the obstacle.
2. A human force tugging the anchor rope and great enough to detach the anchor from the obstacle.
3. A human force tugging an additional rope to the regular anchor rope, the additional rope being attached to a different part of the anchor from the part to which the regular anchor rope is attached.

Another known type of anchor, commonly called a stocked anchor, has a stock which occupies an ample space on board a ship or on dry land, sitting unstable. In order to overcome this demerit, a type with a retractable stock has been devised; however, this anchor with a retractable stock has been more costly than the conventional one with an unretractable stock.

The type of anchor designed to have a great biting force even when the bottom material is mud or sand has been apt to bring up the mud or the sand of the bottom, requiring much time and backbreaking labor of holding the anchor near the water surface and shaking it many times until the mud or the sand is washed off.

And still another type of anchor such as Danforth anchor uses a mechanism of a swinging fluke which hinges on a pivot on one end of a shank. This mechanism enables this type of anchor to regain its biting force when the anchor turns upside down and starts to drag; this ability to regain biting force is one of its good merits. However, this anchor also has a demerit: the user of this often gets his or her finger pinched in between the shank and the swinging fluke.

Yet another type of anchor is a stockless, single-fluke anchor with a movable line connection; the one disclosed in U.S. Pat. No. 4,523,539 and also the one disclosed in U.S. Pat. No. 5,188,055 belong to this type. However, even the anchor of this type faces a problem: if the anchor reaches bottom in such a posture that the aspect of the anchor's fluke is adverse to the tugging force of the anchor and if the point of the anchor rope's engagement to the anchor shank happens to be too close to the base part of the shank, it will not have a good hold onto the bottom; it most probably will back out and drag on. With this type of anchor the tendency to drag is more marked when the bottom material is, like sand, fairly flat and firm.

The object of the invention is to provide a lightweight anchor which can be easily fabricated, put into practical use, and readily handled, hence avoiding the problems mentioned above.

BRIEF DESCRIPTION OF THE DRAWINGS

The drawings below are solely for description of the present invention and do not restrict the embodiment of the claims thereof.

Figure 1:
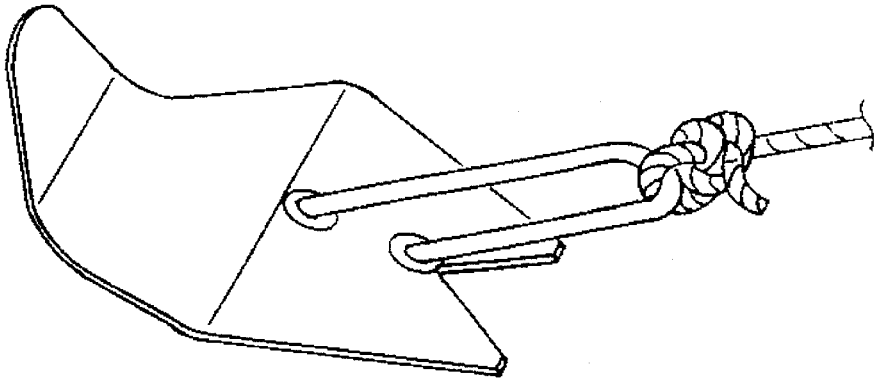
FIG. 1 is a perspective view of the anchor of a first embodiment.

1: a tail fin
2: a fluke
3: a shank
4: a ring(or a shackle)
5: an anchor rope(or an anchor chain)
6: a big notch
7: an opening
8: seabed(or sea bottom)
9: a reinforcement rib

DETAILED DESCRIPTION OF THE INVENTION

Figure 5:
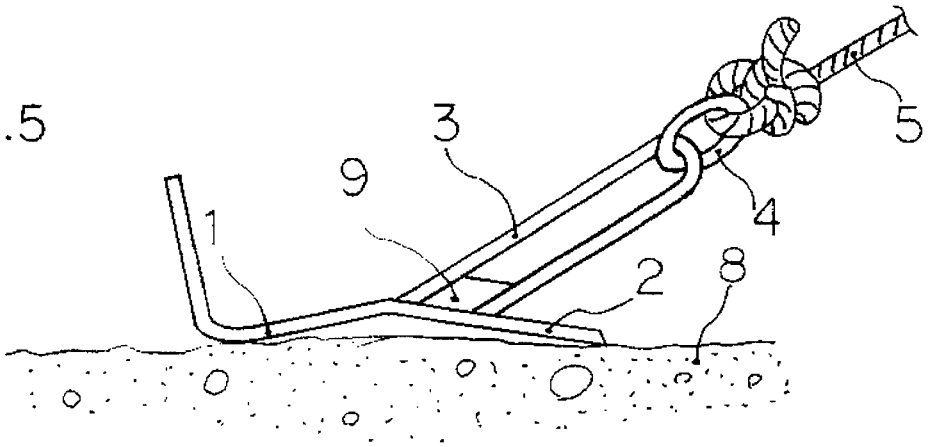
FIG. 5 illustrates the state of the anchor when it has reached the bottom, sitting normal (sometimes after recovering from its upside-down position.)

The main part of the anchor is fabricated of sheet steel either bent into the shape of an elongated 's' as shown in FIG. 5 or with a tail fin 1 welded to a fluke 2 into the similar shape.

Figure 9:
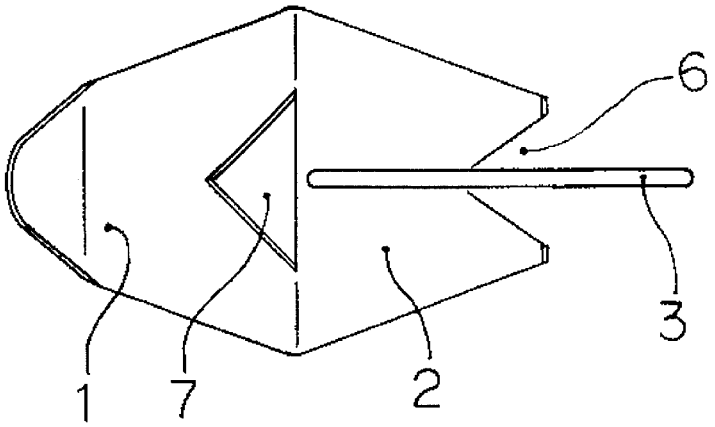
FIG. 9 is a top view of the anchor of the second embodiment, having an opening.

FIG. 9 shows that the width of the anchor is the greatest at the border part where the tail fin abuts the fluke, the great width giving stability to the anchor. The tail fin is tapered, gradually lessening its width toward the end part, where it becomes a smoothly round arc. The fluke is also tapered with its width lessening toward its end part. The width includes that of a big notch which is cut out in the fluke; hence the fluke, viewed from the top, resembles the alphabet letter 'w.'

A ring 4 is pearced through by a steel bar of a shank 3 bent in a U shape, as shown in FIG. 5, the base part of the shank 3 welded to that of the fluke 2. The ring can be substituted by a shackle, or even by a rope 5 with its end part formed into a loop; for one of the mainmost points of this invention is that one end of an anchor rope 5 slides and moves along the most length of the shank 3. The best angle between the fluke 2 and the shank 3 was around 40 degrees, and the best angle between the tail fin I and the fluke 2 was around 160 degrees. With the maximum width of the anchor being 100, the fully stretched relative length of tail fin 1 is best at 90 to 110, total length of fluke 2 is best at some 75, and that of the shank 3 at some 110.

A big notch 6 is cut into the fluke as shown in FIGS. 1 to 4 and in FIG. 9. The notch gives the fluke a greater digging when the bottom material is either mud or sand, and a greater hold on the bottom when the bottom material is a rocky one.

Figure 2:
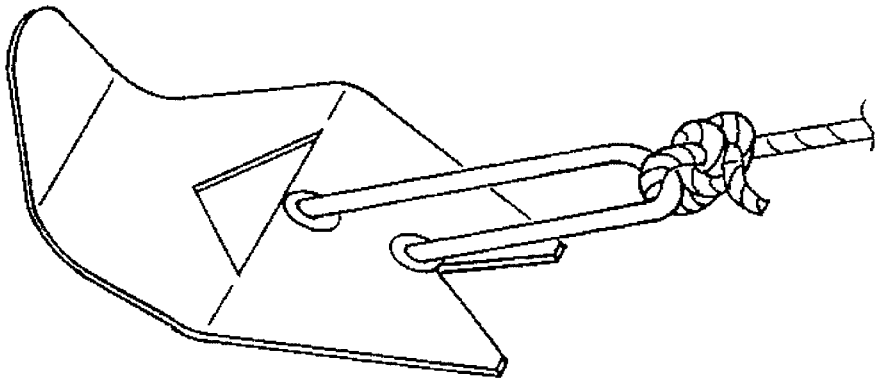
FIG. 2 is a perspective view of the anchor of a second embodiment.
Figure 3:
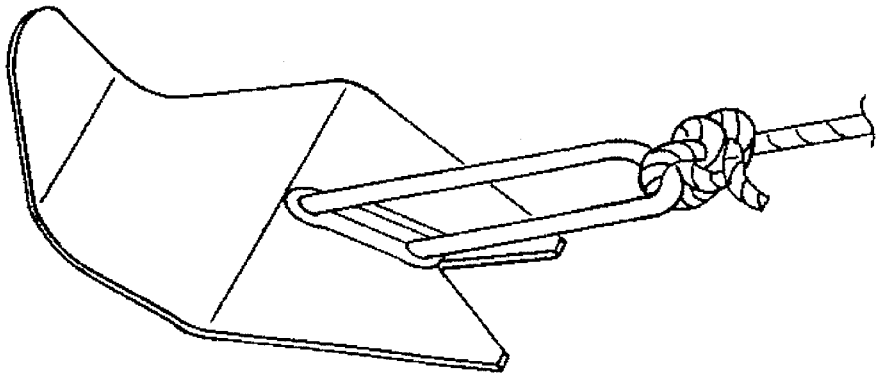
FIG. 3 is a perspective view of the anchor of a third embodiment.
Figure 4:
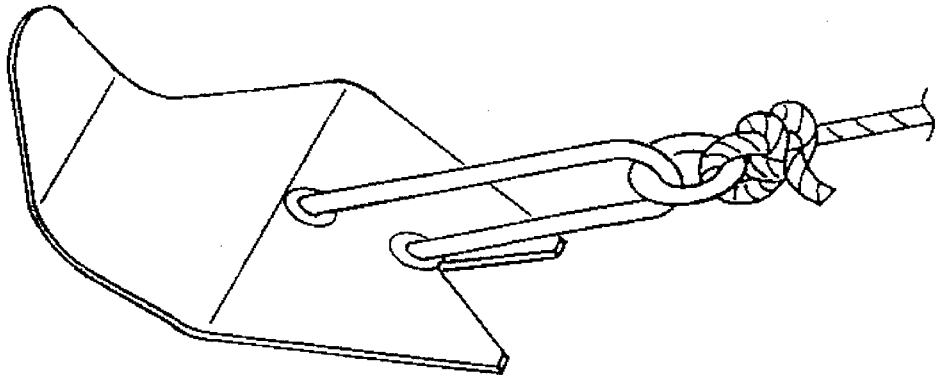
FIG. 4 is a perspective view of the anchor of another embodiment.
Figure 10:
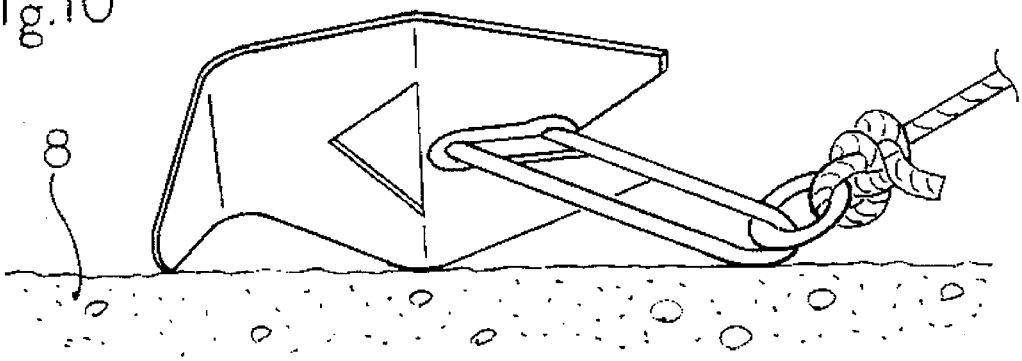
FIG. 10 is a side view of the anchor when it has reached the bottom and is sitting upside down.
Figure 11:
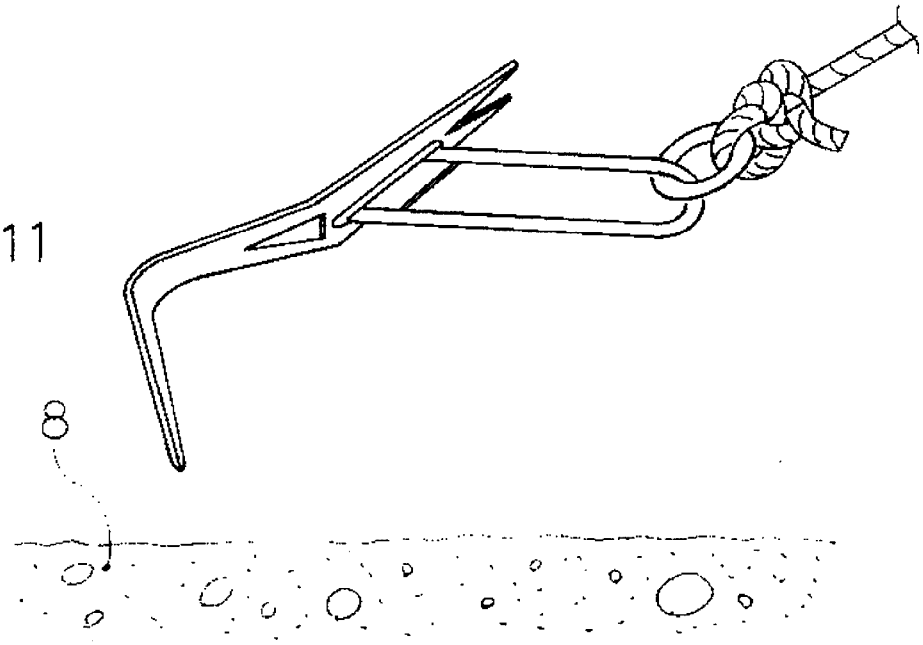
FIG. 11 illustrates the state of the anchor right before it turns underwater and recovers its normal position after being impulsively tugged with anchor rope 5; the state succeeding the anchor state of FIG. 10.

An opening 7 as shown in FIG. 2 and in FIGS. 9 to 11 enables the anchor to quickly reach the aimed spot on the bottom. When the fluke is made of relatively thick sheet steel the opening can be dispensed with because of its relative weight: the opening is for to reduce the resistance of water. With respect to cost and easiness of fabrication, a triangle with one of its sides coinciding either with the welded line or with the line of bending is the best shape for the opening.

A reinforcement rib 9 as shown in FIGS. 3, 5 to 8, 10 and 11 is added in order to increase strength of the welded part, hence not necessary when the anchor is too small.

The invention, thus described, has these effects:

1. The effects of tail fin shape

The tail fin of this invention, as shown in FIGS. 1 to 4, is featured by its unique shape:

A. Its width narrowing toward its end.

B. The shape of its end (i.e. an arc.)

C. Its upward-bent end part.

One effect of the tail fin shape is that the tail fin adjusts the balance of the anchor and corrects its position to a normal one even if the anchor reaches bottom upside down. This position-correcting mechanism can be divided into two patterns:

Pattern 1 (when the angle between the line of the anchor rope and the water surface is 30 degrees or below):

If the anchor rope 5 is slowly tugged, the upside-down-placed anchor does not turn to its normal position and merely drags on with its upward-bent end of the tail fin vainly raking the bet tom material. However, if given a strong and impulsive tug or two to its anchor rope, the anchor becomes detached front the bottom as shown in FIG. 11 and, because of its shape and the position of its gravity center, turns underwater to its normal position as shown in FIG. 5.

Pattern 2 (when the angle between the line of the anchor rope and the water surface is over 30 degrees):

Even if the anchor rope 5 is slowly tugged, the upside-down-placed anchor turns underwater while it drags with its upward-bent tail fin raking the bottom material until it gains its normal position as shown in FIG. 5.

Figure 6:
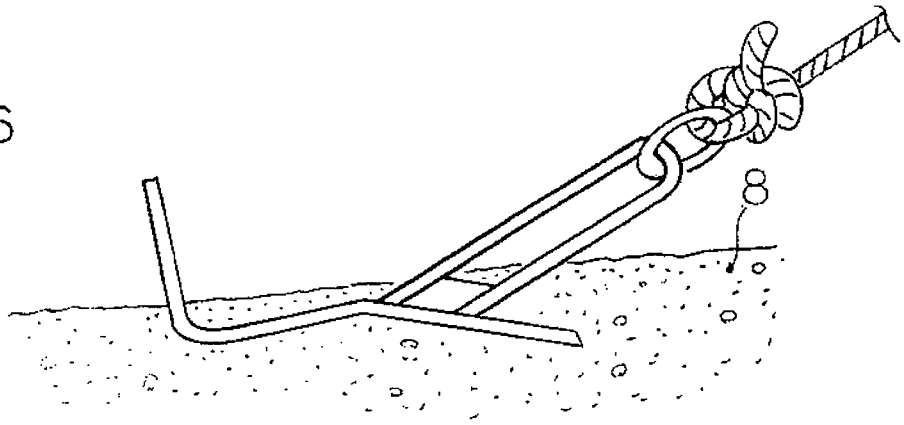
FIG. 6 illustrates the anchor sitting normal with its fluke holding the bottom (the bottom material being sand, mud, or the like: soft material.)
Figure 7:
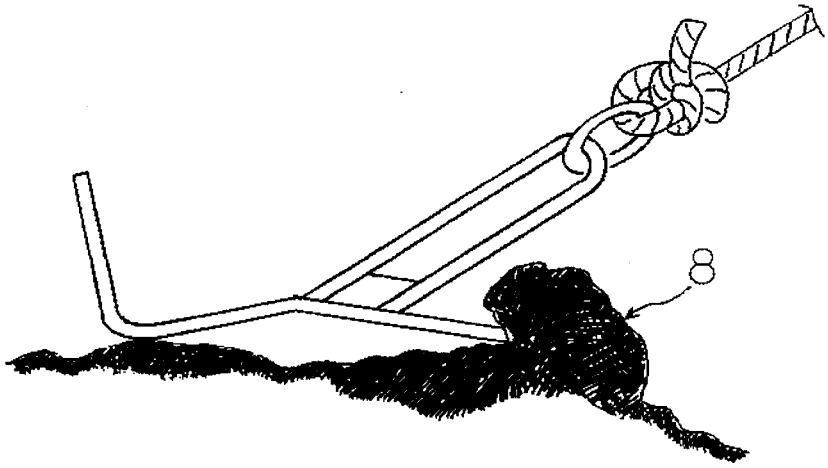
FIG. 7 illustrates the anchor sitting normal with its fluke holding the bottom (the bottom material being rock or the like: hard material.)

Given a slow and steady tug to its anchor rope, the fluke of the anchor in normal position digs into the bottom as in FIGS. 6 and 7. Thus tugging by man's hand is essential to the handling of this anchor; and the invention name, 'lightweight anchor with tail fin,' partly derives from the fact that the anchor of this invention has to be light enough to be handled by man's hand.

The second effect of the tail fin shape is that it prevents abrupt drag of the anchor. The tail fin with its end bent upward has a shape of much resistance and therefore retards an abrupt motion of the anchor: because of its upward-bent tail fin end, the anchor in its upside-down position and when dragging moves heavily when the bottom material is sand or mud, and stops moving when the tail fin end hits a heavy rock. This retardation of abrupt motion contributes to safety.

The third effect of the tail fin shape is that its upward-bent end shape contributes to a better control of the anchor in making it reach its aimed spot on the bottom; the upward-bent end functions as a stabilizer.

The fourth effect of the tail fin shape is that it makes smooth the withdrawal movement of the anchor. At its first stage of heaving up the anchor backs out a little from the position of FIG. 8. The upward-bent shape of the tail fin reduces the friction against, and hence the resistance to, the bottom surface and enhances its smooth withdrawal.

2. The effect of tail fin length When the anchor reaches the bottom the aspect of the anchor on the bottom does not have to coincide with the direction line of the anchor rope 5 along which the anchor is tugged. By giving it a quick and impulsive tug or two, or even a slow tug, half upward toward its user, the aspect of the anchor can be corrected: the tail fin has a certain amount of length and therefore a tendency to remain where it is while the fluke 2 tends to face the opposite direction, the direction toward which the anchor rope 5 is tugged. A longer tail fin is more effective in increasing the aspect-correction tendency as mentioned above. But a too lengthy one is inconvenient to carry around or to have on board or in a garage. Also, a too lengthy tail fin prevents the anchor from quickly reaching the aimed spot on the bottom. Hence the best advisable length of the tail fin is from 1.2 to 1.5 times that length of the fluke, 3. The effect of shank 3

Figure 8:
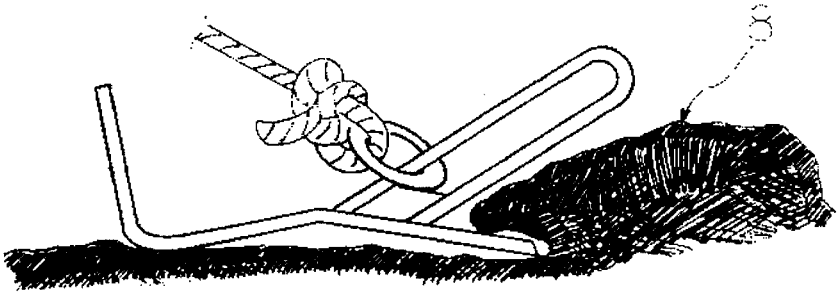
FIG. 8 illustrates the state of the anchor, the state just about to be pulled off and retrieved from the bottom. The pulling off and retrieval is done by the user of the anchor who simply gives anchor rope 5 a tug toward tail fin 1. When an anchor is normally biting the bottom or when it is stuck in the bottom, a boat on one end of its anchor rope is moored downstream or in the position downside of the water current. If the anchor rope is tugged, the boat moves upstream or toward the spot of the water surface right above the anchor. The pulling off and retrieval is done with the boat moved past the spot right above the anchor and farther on upstream. Thus the boat on one end of the anchor rope or the anchor in FIG. 8 is in the position upstream of its mooring. Names of the anchor parts in FIGS. 5 and 9 are.

The shank of this anchor is made of bar steel bent in the shape of an elongated U letter. The U-shaped structure of steel bar, and hence a double-barred structure, enables the shank to endure a fairly strong bending force. The anchor stuck in the bottom may not be released if the anchor rope is tugged right upward: in the direction perpendicular to water surface. However, it can be released if the anchor rope is given an impulsive tug or two halfway upward and opposite to the direction of its fluke's biting; because, as shown in FIG. 8, the tugging of anchor rope 5 moves the ring 4 along the most length of the shank 3 until the ring comes very close to the fluke 2. The backward force thus excerted on the part of the shank very close to the fluke then releases the anchor from the bottom.

4. The effect of entire anchor shape (1) Using no stock the anchor occupies only a narrow space on board a ship or on dry land. Also it is stable to set and safe to handle.

(2) Simply structured the anchor brings up little mud or sand from the bottom. Therefore, it requires little time and labor of holding the anchor near the water surface arid shaking it until the anchor is cleaned.

(3) The simple structure of the anchor reduces the cost of manufacture.

(4) The shank 2 is immovably welded to the fluke 3, and this increases safety in handling the anchor, avoiding the danger of getting its user's finger pinched between two moving parts.

I claim:

1. A lightweight anchor comprising:

a tail fin having an unpointed end part: and a border part that abuts a fluke part of said anchor; said tail fin and said fluke part being substantially one piece; said tail fin being bent downward at said border part relative to the fluke part and then upward around a middle part between said end part and said border part; the width of said tail fin being the greatest at said border part and gradually lessening toward said end part, a plow-shaped single fluke; the width of said fluke lessening toward its end and wherein a notch is provided, and a shank of a bar being bent into a U-shape and immovably welded to an upper surface of said fluke part.

2. The anchor of claim 1 in which an opening is provided in said tail fin.

3. The anchor of claim 1 in which a reinforcement rib is added to a base of said shank; said reinforcement rib and said shank being immovably welded to the upper surface of said fluke.

4. The anchor of claim 1 in which a ring is pearced through by said bar of said shank for attachment of an anchor line.

* * * * *